US009845968B2

(12) United States Patent
Couto

(10) Patent No.: US 9,845,968 B2
(45) Date of Patent: Dec. 19, 2017

(54) SYSTEMS AND METHODS FOR VENT PROTECTION ENCLOSURES

(71) Applicant: Wally Couto, Burlington (CA)

(72) Inventor: Wally Couto, Burlington (CA)

( * ) Notice: Subject to any disclaimer, the term of this patent is extended or adjusted under 35 U.S.C. 154(b) by 751 days.

(21) Appl. No.: 14/194,515

(22) Filed: Feb. 28, 2014

(65) Prior Publication Data

US 2014/0364049 A1 Dec. 11, 2014

Related U.S. Application Data

(60) Provisional application No. 61/831,732, filed on Jun. 6, 2013.

(51) Int. Cl.
*F24F 7/00* (2006.01)
*F24F 13/08* (2006.01)

(52) U.S. Cl.
CPC ..... *F24F 13/084* (2013.01); *F24F 13/08* (2013.01); *F24F 2221/54* (2013.01); *Y10T 29/49826* (2015.01)

(58) Field of Classification Search
CPC ..... F24F 13/08; F24F 7/02
USPC ..... 454/275–283, 366, 367, 368, 4
See application file for complete search history.

(56) References Cited

U.S. PATENT DOCUMENTS 2,663,246 A * 12/1953 Smith ..... F24F 13/08 454/279
3,393,859 A * 7/1968 Giummo ..... B65D 5/305 229/192
5,591,080 A 1/1997 Ward
D416,781 S 11/1999 Ward et al.
D431,291 S 9/2000 McKee
6,149,516 A 11/2000 Mantyla
6,155,008 A 12/2000 McKee
D439,009 S 3/2001 Broeders
6,299,529 B1 * 10/2001 Preston ..... F24F 13/082 454/367
6,612,924 B1 9/2003 Mantyla et al.
6,767,281 B2 7/2004 McKee
7,219,473 B2 5/2007 Mantyla et al.
7,610,726 B2 * 11/2009 Lajewski ..... F24F 7/00 248/220.21
7,774,999 B2 8/2010 McKee
2003/0037586 A1 * 2/2003 Durney ..... B21D 28/10 72/379.2
2007/0010190 A1 1/2007 Butler
2009/0007503 A1 * 1/2009 Thompson ..... E04H 9/14 52/202

(Continued)

OTHER PUBLICATIONS

"IE 337: Materials and Manufacturing Processes Lab #7." Oregon State University, Mar. 3, 2010. Web. 14 Spet. 2016.*

(Continued)

*Primary Examiner* — Avinash Savani
*Assistant Examiner* — Vivek Shirsat
(74) *Attorney, Agent, or Firm* — Steven M Greenberg; CRGO Law

(57) ABSTRACT

A generally planar blank made, for example, from sheet metal can be formed into a vent protector that can be mounted to an outer wall of a structure over the exhaust aperture of a vent to inhibit vertebrate wildlife from entering the vent. The vent protector forms an enclosure for receiving vent flaps that may extend outwardly from the wall of the structure.

20 Claims, 8 Drawing Sheets

(56) References Cited

U.S. PATENT DOCUMENTS

| | | | | |
|---|---|---|---|---|
| 2009/0053990 | A1 | 2/2009 | McKee | |
| 2010/0075590 | A1* | 3/2010 | Rico | H05K 7/20127 454/367 |
| 2011/0294412 | A1* | 12/2011 | Vagedes | F24F 7/02 454/242 |
| 2011/0312263 | A1* | 12/2011 | Grandmaison | F24F 13/082 454/283 |
| 2013/0078903 | A1 | 3/2013 | Mantyla et al. | |
| 2014/0065946 | A1* | 3/2014 | Tovmasyan | E04D 13/17 454/358 |

OTHER PUBLICATIONS

DURAFLO; Ventguard Plus RD50 Control the Wild!; accessible at http://duraflo.com/Portals/0/ProductDownloads/RD50.pdf; last accessed on Aug. 24, 2014.

* cited by examiner

SYSTEMS AND METHODS FOR VENT PROTECTION ENCLOSURES

CROSS-REFERENCE TO RELATED APPLICATION

The present application claims priority to U.S. Provisional Application No. 61/831,732 filed on Jun. 6, 2013, the teachings of which are hereby incorporated by reference.

TECHNICAL FIELD

The present disclosure relates to vent protection devices, and more particularly to vent protection devices which may be formed from generally planar blanks.

BACKGROUND

Most modern homes are equipped with ventilation systems for heating and cooling, and these systems allow air to be exhausted to the exterior of the home. Such ventilation systems allow the home to be cooled in the summer and warmed in the winter. While this is pleasing to the occupants, vertebrate wildlife such as squirrels may also prefer to be cooler in summer and warmer in winter, and the ducts can provide an attractive nesting space.

As a result, it has been known to place mesh screens or molded plastic covers over the external vents in an effort to exclude vertebrate wildlife. However, squirrels, being industrious critters, are often not thwarted by such devices, and have been known to chew through or otherwise defeat such vent covers. While this leads to a comfortable home for the squirrel or other vertebrate, it is less so for the residents of the dwelling, as the unwanted animal guests may chew on wiring or cause other damage.

SUMMARY

A generally planar blank made, for example, from sheet metal can be formed into a vent protector that can be mounted to an outer wall of a structure over the exhaust aperture of a vent to inhibit vertebrate wildlife from entering the vent. The vent protector forms an enclosure for receiving vent flaps that may extend outwardly from the wall of a structure.

In one embodiment, a vent protector comprises a main ventilation portion, a plurality of spacer portions and a plurality of mounting portions. The main ventilation portion has a first plurality of ventilation apertures for permitting fluid flow past the main ventilation portion and inhibiting ingress of vertebrate wildlife past the main ventilation portion. The spacer portions extend from the main ventilation portion, and adjacent edges of the spacer portions are in registration with one another to form an enclosure having an opening opposite the main ventilation portion and which inhibits ingress of vertebrate wildlife past the enclosure. The mounting portions extend from at least two of the spacer portions for mounting the vent protector to a surface. The main ventilation portion, the spacer portions, and the mounting portions are made from a monolithic metal sheet, and the main ventilation portion, the spacer portions and the mounting portions are separated by bend lines.

Preferably, the monolithic metal sheet is bendable along the bend lines with energy of less than about 12 inch-pounds, more preferably with energy of less than about 10 inch-pounds and still more preferably with energy of less than about 8 inch-pounds.

In one preferred embodiment, the bend lines comprise a series of substantially linearly arranged bend apertures to reduce resistance to bending along the bend lines, relative to resistance to bending of the main ventilation portion, the spacer portions, and the mounting portions.

Preferably, the monolithic sheet has a thickness between about 14 gauge and about 24 gauge, more preferably between about 18 gauge and about 22 gauge, and still more preferably about 20 gauge.

In one embodiment, the spacer portions comprise at least two opposed side spacer portions from which the mounting portions extend and at least two opposed end spacer portions. In a particular embodiment, the main ventilation portion is substantially rectangular, the at least two opposed side spacer portions are two opposed substantially trapezoidal side spacer portions, and the at least two opposed end spacer portions are two opposed substantially non-rectangular isosceles trapezoidal end spacer portions. In such an embodiment, each spacer portion has a proximal edge along the bend line separating the respective spacer portion from the main ventilation portion and a distal edge relative to the proximal edge, and preferably, for each spacer portion, the proximal edge is shorter than the distal edge so that the spacer portions taper outwardly from the main ventilation portion.

In some embodiments, an inferior one of the end spacer portions has a second plurality of ventilation apertures formed therein for permitting fluid flow past the inferior one of the end spacer portions and inhibiting ingress of vertebrate wildlife past the inferior one of the end spacer portions.

The vent protector may further comprise respective tabs extending from at least some of the spacer portions, with each tab being secured to an adjacent spacer portion to secure each spacer portion to each adjacent spacer portion.

Preferably, the monolithic metal sheet has rounded cutouts at intersection points where (a) the bend lines between the main ventilation portion and the end spacer portions and (b) the bend lines between the main ventilation portion and the side spacer portions intersect, so that vertices of the main ventilation portion, the end spacer portions and the side spacer portions are subsumed by the cutouts.

In an embodiment, a dwelling structure comprises a plurality of upstanding exterior walls, a roof that extends over the exterior walls and cooperates with the exterior walls to form an interior of the dwelling structure, a ventilation duct extending from within the interior of the dwelling structure to an exhaust aperture in one of the exterior walls, a vent structure secured over the exhaust aperture, and a vent protector as described above secured to the exterior wall over the vent structure so that the opening opposite the main ventilation portion is in registration with the vent structure and the exhaust aperture. The vent protector is secured by the mounting portions being secured to the exterior wall.

In a particular embodiment of the dwelling structure, the vent structure comprises movable flaps that are movable between a closed position and an open position in which the flaps extend outwardly beyond the exterior wall, permitting fluid flow from the interior of the dwelling structure through the exhaust aperture via gaps between the flaps. In the open position, the flaps extend through the opening opposite the main ventilation portion into, and the flaps are contained within, the enclosure formed by the vent protector, so that fluid can flow from the interior of the dwelling structure through the ventilation duct, through the exhaust aperture and the gaps between the flaps into the enclosure, and through the ventilation apertures to ambient.

In one particular embodiment, a superior end spacer portion of the vent protector slopes at a sharply oblique angle to the main ventilation portion of the vent protector.

A dwelling structure as described above may be retrofitted with a vent protector comprising a ventilated enclosure and a plurality of mounting portions extending from the enclosure substantially parallel to one another by securing the at least one vent protector over the vent structure so that the mounting portions are secured to the exterior wall of the dwelling structure and the flaps of the vent structure, when in the open position, extend into and are contained within the enclosure.

A method for making a vent protector is also described. The method comprises providing a blank, the blank comprising a main ventilation portion having a first plurality of ventilation apertures for permitting fluid flow past the main ventilation portion and inhibiting ingress of vertebrate wildlife past the main ventilation portion, a plurality of spacer portions extending from the main ventilation portion, and mounting portions extending from at least two of the spacer portions for mounting the vent protector to a surface. The blank is made from a monolithic metal sheet, and the main ventilation portion, the spacer portions, and the mounting portions are separated by bend lines. The method further comprises hand bending the blank along the bend lines separating the main ventilation portion from the spacer portions to place adjacent edges of the spacer portions into registration with one another to form an enclosure with an opening opposite the main ventilation portion, hand bending the blank along the bend lines separating the mounting portions from the respective spacer portions so that the mounting portions are substantially parallel to the main ventilation portion, and securing adjacent spacer portions to one another.

The method of claim 14, wherein hand bending the blank along the bend lines separating the main ventilation portion from the spacer portions and hand bending the blank along the bend lines separating the mounting portions from the respective spacer portions comprises bending the blank along the bend lines with energy of less than about 12 inch-pounds, more preferably with energy of less than about 10 inch-pounds and still more preferably with energy of less than about 8 inch-pounds. Also preferably, hand bending the blank along the bend lines separating the main ventilation portion from the spacer portions and hand bending the blank along the bend lines separating the mounting portions from the respective spacer portions omits use of any brake.

In a preferred embodiment, the bend lines comprise a series of substantially linearly arranged bend apertures to reduce resistance to bending along the bend line, relative to resistance to bending of the main ventilation portion, the spacer portions, and the mounting portions.

Securing adjacent spacer portions to one another may comprise securing respective tabs extending from at least some of the spacer portions to adjacent spacer portions to secure each spacer portion to each adjacent spacer portion.

The method may further comprise powder coating the vent protector after hand bending the blank.

Preferably, hand bending the blank takes less than about 10 seconds.

A method of making a blank for constructing a vent protector comprises the steps of (a) providing a sheet metal section, (b) forming a plurality of ventilation apertures in the section to form a main ventilation portion, (c) cutting away corners of the sections to form a plurality of spacer portions extending from the main ventilation portion, (d) forming bend lines between the main ventilation portion and the respective spacer portions, and (e) forming bend lines between opposed spacer portions and respective mounting portions extending from the opposed spacer portions. Steps (b), (c), (d), and (e) may be performed in any order. The bend lines may be, for example, perforated lines or score lines.

Cutting away corners of the sections to form a plurality of spacer portions extending from the main ventilation portion preferably comprises forming tabs extending from at least some of the spacer portions for securing adjacent spacer portions to one another. Boundaries between the spacer portions and the tabs are formed by further bend lines to facilitate folding of the tabs. The method preferably further comprises forming mounting apertures through the mounting portions.

In another embodiment, a vent protector may be formed from a generally circular or ovoid blank having a plurality of tab slits extending inwardly from the edge thereof. Bend lines extend circumferentially around the blank, spaced inwardly from the edge thereof, in a regular polygonal arrangement. The tab slits terminate at the bend lines so as to form a plurality of outwardly extending peripheral tabs. The polygon has a plurality of ventilation apertures defined therethrough. A cone-forming cut extends from a generally central position within the polygon to the edge of the blank. By sliding one of the edges formed by the cone-forming cut underneath the other, the blank may be formed into a generally conical shape and then secured in the conical configuration. The tabs are folded toward the apex of the cone for mounting the vent protector.

BRIEF DESCRIPTION OF THE DRAWINGS

These and other features will become more apparent from the following description in which reference is made to the appended drawings wherein.

DETAILED DESCRIPTION

Figure 1:
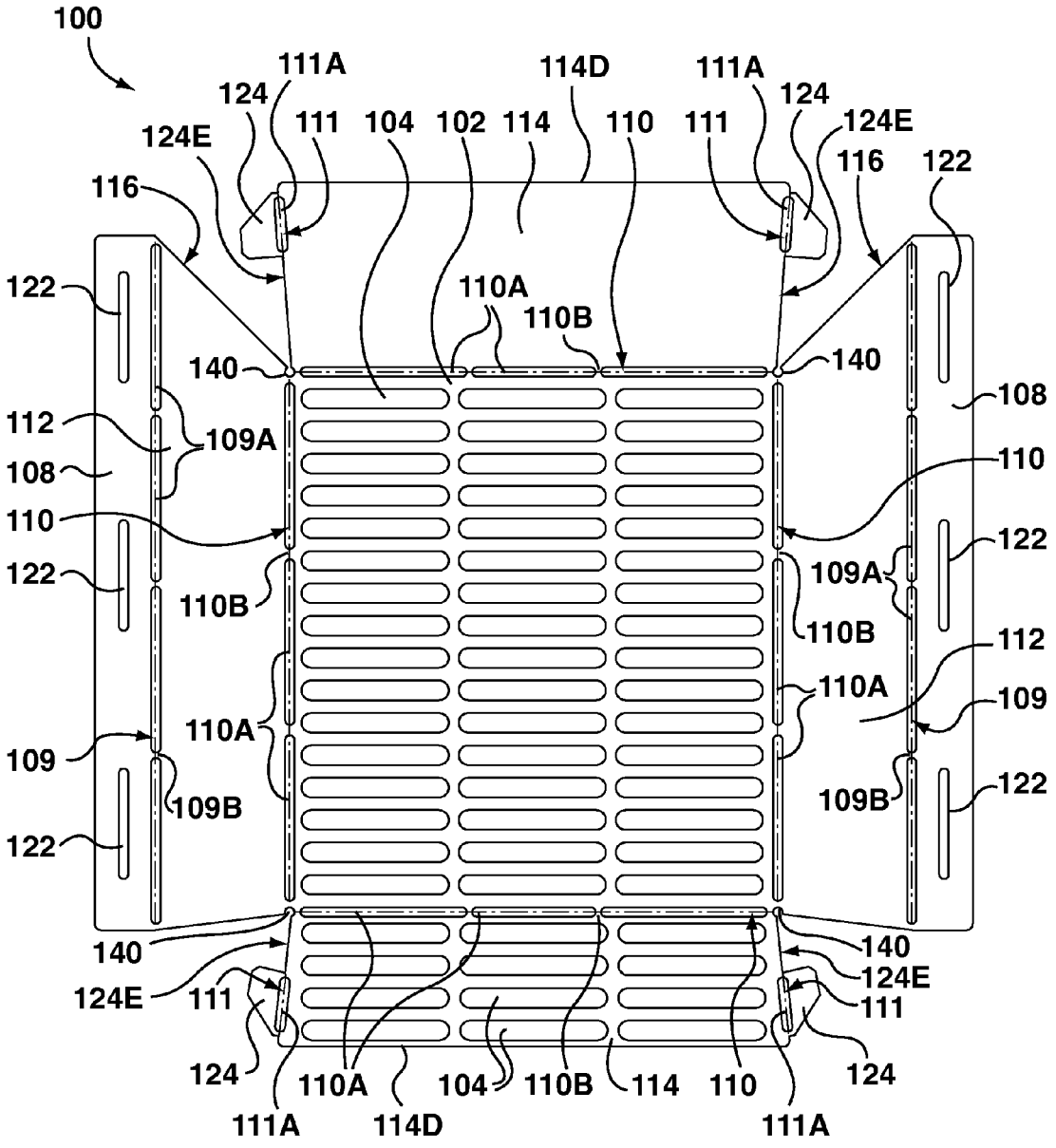
FIG. 1 is a plan view of a first exemplary blank for constructing a vent protector, shown in an unfolded condition.

FIG. 1 shows an exemplary blank, indicated generally at 100, for constructing a vent protector, such as the vent protector 200 described below. The blank 100, when in an unfolded condition as shown in FIG. 1, is generally planar, of monolithic construction, and made of metal, such as stainless or galvanized steel or aluminum, which provide a good strength to weight ratio. Other metals of sufficient strength could also be used. The blank 100 comprises a main ventilation portion 102 which has a first plurality of ventilation apertures 104 formed therein. When the blank 100 is formed into a vent protector 200, the ventilation apertures 104 permit fluid flow past the main ventilation portion 102 and inhibit ingress of vertebrate wildlife past the main ventilation portion 102, and the main ventilation portion 102 and ventilation portion are adapted for this purpose. The ventilation apertures 104 provide a sufficient aggregate area to accommodate the fluid flow from an exhaust vent on the building to which the vent protector 200 will be affixed, but are individually small enough to prevent vertebrate wildlife such as birds, squirrels, chipmunks, etc. from crawling through.

A plurality of spacer portions 112, 114 extend from the main ventilation portion 102 for spacing the main ventilation portion 102 from a vent exit when the blank 100 is formed into a vent protector 200. This spacing accommodates the flaps on the vent structure of a dwelling or other building, as described further below.

In a preferred embodiment, the spacer portions 112, 114 comprise two opposed side spacer portions 112, from which mounting portions 108 extend, and two opposed end spacer portions 114. The mounting portions 108 are used for mounting a vent protector formed from the blank 100 to a surface. Although FIG. 1 shows two mounting portions 108 extending from the side spacer portions 112, the mounting portions 108 can instead extend from the end spacer portions 114. In other alternate embodiments, mounting portions can extend from all of the spacer portions or some suitable combination of the side spacer portions and the end spacer portions 112, 114. To mount the vent protector 200 to a surface, the mounting portions 108 have mounting apertures 122 for receiving fasteners such as screws or other anchoring devices or another mechanical device to secure the vent protector 200 to a surface, such as the outside wall of a structure. Although the illustrated embodiment has two side spacer portions 112, two end spacer portions 114 and two mounting portions 108, in alternate embodiments, any of the side spacer portions, end spacer portions and/or mounting portions can be divided into two or more side spacer portions, end spacer portions and/or mounting portions. In one preferred embodiment, the main ventilation portion 102 has a length of about 10¾ inches adjacent the side spacer portions 112 and a length of about 9½ inches adjacent the end spacer portions 114 and the spacer portions 112, 114 are dimensioned such that, when the blank 100 is formed into a vent protector 200 (FIGS. 2A to 2D) and mounted to an exterior wall 152 (FIG. 6*a*), the main ventilation portion 102 is spaced about 2¾ inches from the exterior wall 152 at its closest point thereto.

Thus, the main ventilation portion 102, the spacer portions 112, 114, and the mounting portions 108 are made from a monolithic metal sheet. Preferably, the monolithic sheet has a thickness between about 14 gauge and about 24 gauge, more preferably between about 18 gauge and about 22 gauge, and still more preferably about 20 gauge. In addition, the mounting portions 108 are separated from the side spacer portions 112 by bend lines 109 and the main ventilation portion 102 and the spacer portions 112, 114 are separated from one another by bend lines 110. Thus, the bend lines 110 form the boundary between the main ventilation portion 102 and the spacer portions 112, 114, and the bend lines 109 form the boundaries between the side spacer portions 112 and the mounting portions 108. Preferably, as shown in the exemplary embodiment in FIG. 1, the bend lines 109, 110 are perforated lines and comprise respective bend apertures 109A, 110A, preferably elongate ovoid apertures. Thus, the spacer portions 112, 114 are joined to the main ventilation portion 102 only by the bridge portions 110B between the bend apertures 110A on the bend line 110, and the mounting portions 108 are joined to the side spacer portions 112 only by the bridge portions 109B between the bend apertures 109A on the bend line 109. Since only the bridge portions 109B, 110B must be bent, this arrangement results in reduced resistance to bending along the bend lines 109, 110, relative to resistance to bending of the main ventilation portion 102, the spacer portions 112, 114, and the mounting portions 108 and thereby guiding the folding process.

Preferably, the monolithic sheet, that is, the blank 100, is bendable along the bend lines 109, 110 with energy of less than about 12 inch-pounds, more preferably with energy of less than about 10 inch-pounds and still more preferably with energy of less than about 8 inch-pounds. Preferably, the blank 100 can be bent along the bend lines 110 separating the side spacer portions 112 from the main ventilation portion 102, and along the bend lines 109 separating the side spacer portions 112 from the mounting portions 108, with energy of less than 8 inch-pounds, preferably about 7 inch-pounds. Also preferably, the blank 100 can be bent along the bend lines 110 separating the end spacer portions 114 from the main ventilation portion 102 with energy of less than 6 inch-pounds, preferably about 5 inch-pounds. Further preferably, the blank 100 can be bent along the bend lines 111 separating the tabs 124 from the end spacer portions 114 (or the side spacer portions if the tabs extend from the side spacer portions) with energy of less than 3 inch-pounds, preferably about 2 inch-pounds. In a preferred embodiment, the bend lines 110 separating the side spacer portions 112 from the main ventilation portion 102 are substantially parallel to the bend lines 109 separating the mounting portions 108 from the side spacer portions 112 as shown in FIG. 1.

Figure 2A:
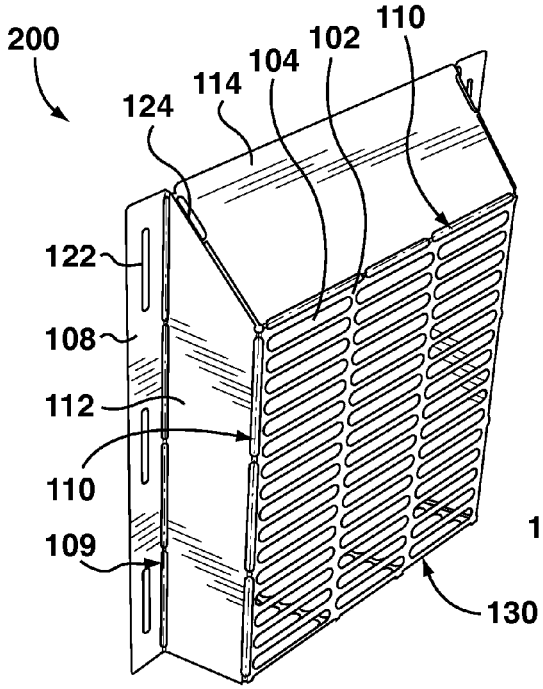
FIG. 2*a* is a first perspective view of a vent protector formed by a blank of FIG. 1 in a folded condition.
Figure 2B:
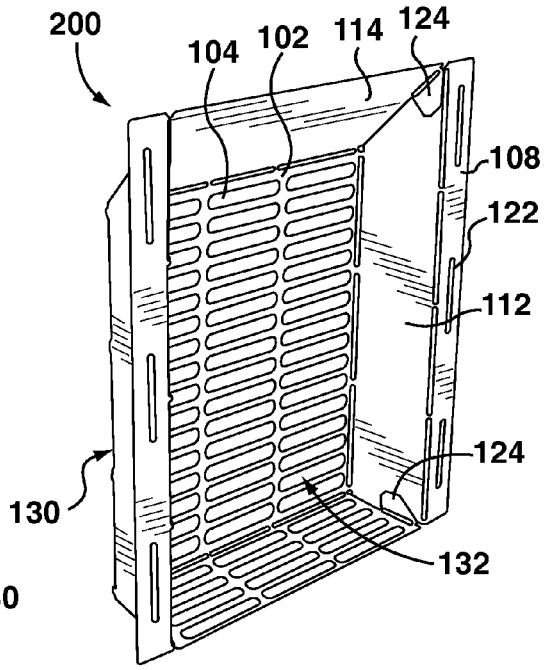
FIG. 2*b* is a rear view of the vent protector of FIG. 2*a;*
Figure 2C:
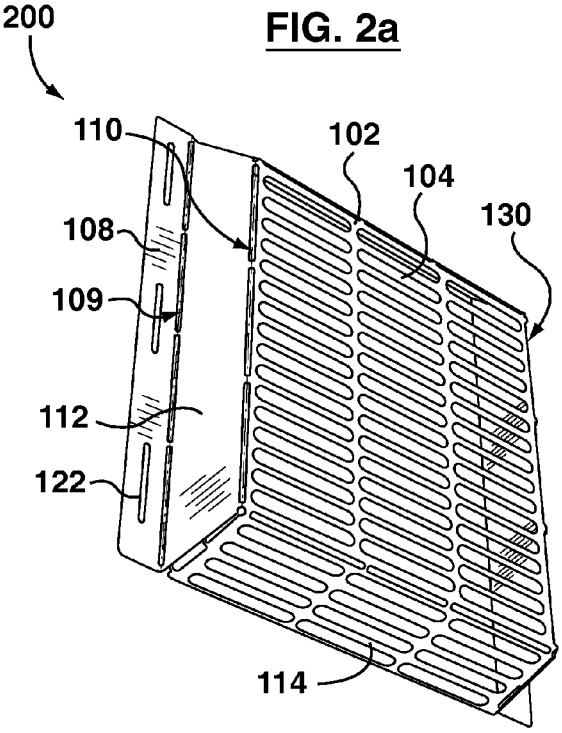
FIG. 2*c* is a second perspective view of the vent protector of FIG. 2*a;*
Figure 2D:
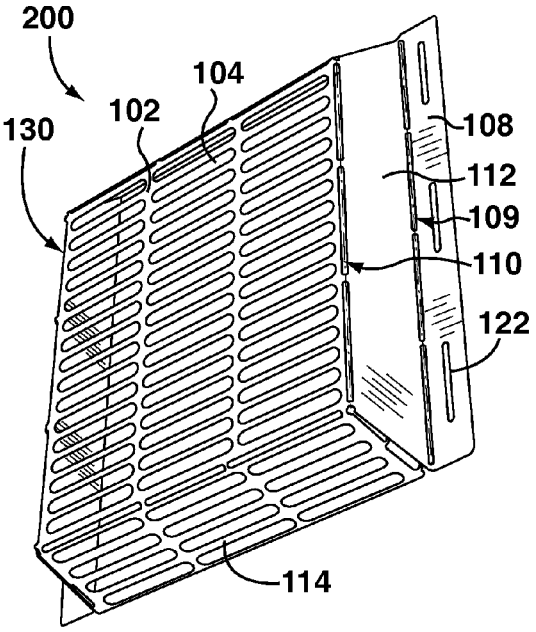
FIG. 2*d* is a third perspective view of the vent protector of FIG. 2*a;*

In the exemplary embodiment shown in FIG. 1, the main ventilation portion 102 is substantially rectangular, the side spacer portions 112 are substantially trapezoidal and the end spacer portions are substantially non-rectangular isosceles (i.e. bilaterally symmetrical) trapezoidal. Thus, both the side spacer portions 112 and the end spacer portions 114 are substantially trapezoidal in shape. Each spacer portion 112, 114 has a proximal edge along the bend line 110 separating the respective spacer portion 112, 114 from the main ventilation portion 102 and a distal edge relative to the proximal edge, with the proximal and distal edges being the bases of the trapezoids formed by the spacer portions 112. The distal edges of the side spacer portions 112 are formed by the bend lines 109 separating the side spacer portions 112 from the mounting portions 108, and the distal edges 114D of the end spacer portions 114 are defined by the termini of the end spacer portions 114. For each spacer portion 112, 114, the proximal edge is shorter than the distal edge so that the spacer portions 112, 114 taper outwardly from the main ventilation portion 102. The result is that when the spacer portions 112, 114 are folded in the same direction by bending the blank 100 along the bend lines 110 to form a vent protector 200 (FIGS. 2*a* to 2*d*), the spacer portions 112, 114 and the main ventilation portion 102 cooperate to form a generally rectangular frusto-pyramidal shape, as can be seen in FIG. 2*a* and FIG. 2*b*. This generally rectangular frusto-pyramidal shape, with the base being coincident with the opening 132 (FIG. 2*b*) facilitates nested stacking of a plurality of vent protectors 200.

Still referring to FIG. 1, respective tabs 124 extend from the end spacer portions 114, in particular from the edges 124E thereof that are the legs (non-parallel edges) of the trapezoids formed by the end spacer portions 114. This is merely one exemplary configuration. In an alternative embodiment, the tabs 124 could extend from the side spacer portions 112 for securing the side spacer portions 112 to the end spacer portions 114, or from both the side spacer portions 112 and the end spacer portions 114, or a suitable combination thereof.

The tabs 124 are separated from the end spacer portions 114 by bend lines 111 which, similarly to the bend lines 109, 110 separating the spacer portions 112, 114 from the main ventilation portion 102, are formed by one or more respective bend apertures 111A to reduce resistance to bending along the bend lines 111. When the blank 100 is bent into a folded configuration to form a vent protector 200, the tabs 124 on the end spacer portions 114 are folded inwardly by bending the blank 100 along the bend lines 111 and secured to the adjacent side spacer portions 112 so as to secure each spacer portion 112, 114 to each adjacent spacer portion 112, 114.

The blank 100 has rounded cut-outs 140 at the intersection points where the bend lines 110 between the main ventilation portion 102 and the end spacer portions 114 intersect the bend lines 110 between the main ventilation portion 102 and the side spacer portions 112. When the blank 100 is bent to form a vent protector, the rounded cut-outs 140 will subsume the vertices of the main ventilation portion 102, the end spacer portions 114 and the side spacer portions 112 and thereby avoid sharp corners.

Figure 6A:
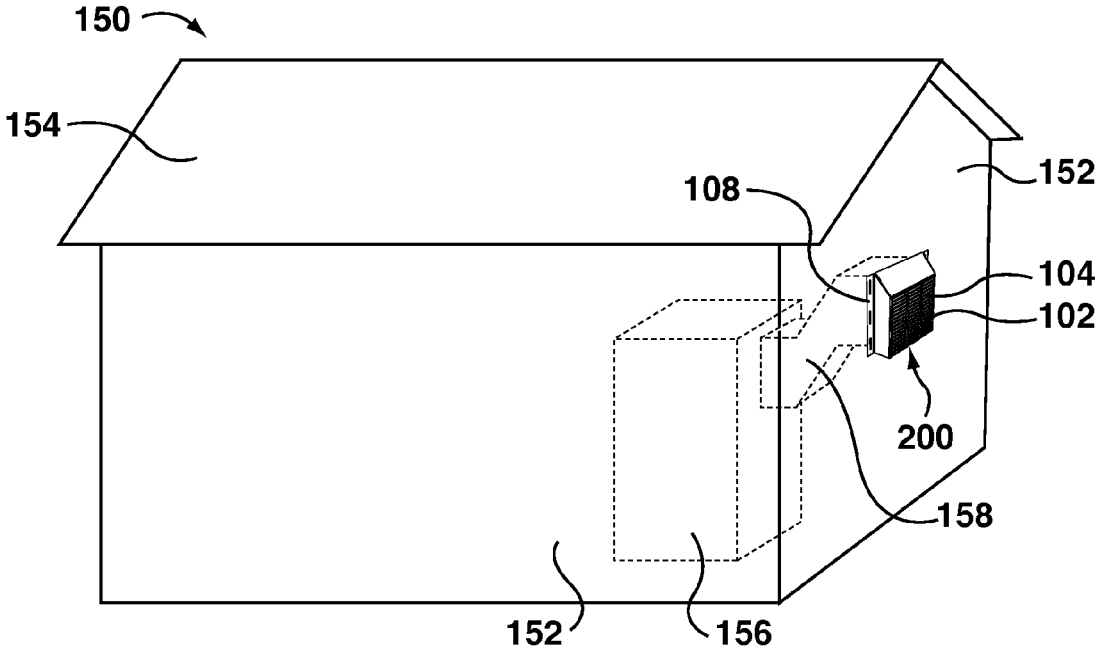
FIG. 6*a* is a front perspective view of a dwelling structure with a vent protector affixed to an exterior wall thereof.
Figure 6B:
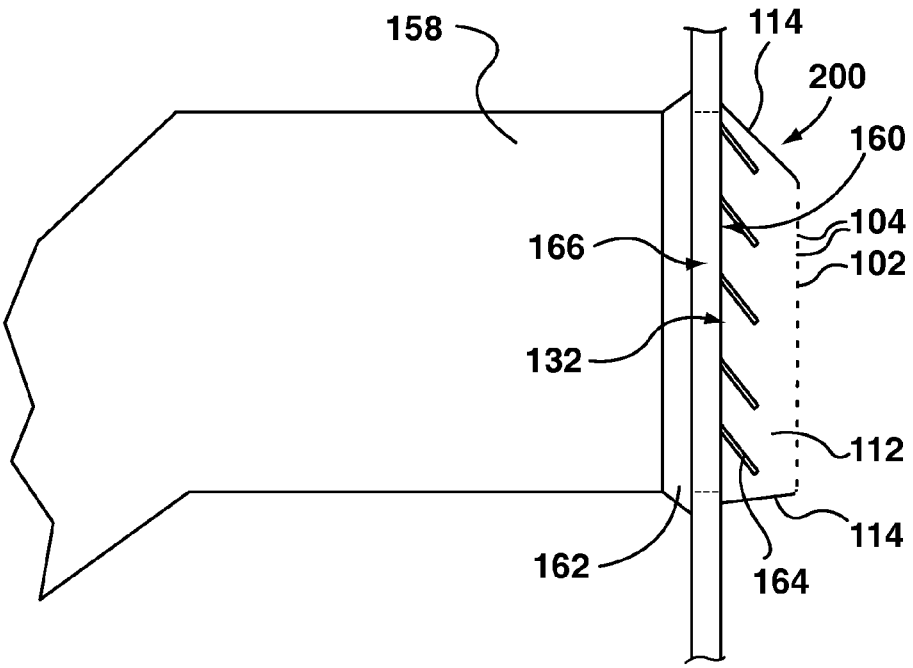
FIG. 6*b* is a cross-sectional view showing a duct of the dwelling structure of FIG. 6*a* in combination with the vent protector of FIG. 6*a;*

Continuing to refer to FIG. 1, in the exemplary embodiment illustrated therein an inferior one of the end spacer portions 114 has a second plurality of ventilation apertures 104 formed therein. Analogously to the ventilation apertures 104 formed in the main ventilation portion 102, the ventilation apertures 104 in the inferior end spacer portion 114 are sized, shaped and positioned, and therefore are adapted, to permit fluid flow past the inferior end spacer portion 114 and inhibit ingress of vertebrate wildlife past the inferior end spacer portion 114. As used in this context, the term "inferior" means that when a vent protector formed from the blank 100 is properly installed on the wall of a building (e.g. as shown in FIGS. 6*a* and 6*b*), the inferior end spacer portion 114 will be closer to the ground than the other end spacer portion 114, which may be considered the "superior" end spacer portion 114.

The edge 116 of the side spacer portion 112 that is closest to the superior end spacer portion 114 extends between the bend lines 110 separating the side spacer portions 112 from the main ventilation portion 102 and the bend lines 109 separating the mounting portions 108 from the side spacer portions 112 at a sharply oblique angle, relative to those bend lines 109, 110. Preferably, the edges 116 of the side spacer portions 112 are at an angle of between about 30 degrees to about 60 degrees to the bend lines 109 separating the mounting portions 108 from the side spacer portions 112, more preferably about 40 degrees to about 50 degrees and still more preferably about 45 degrees.

When folded in the same direction by bending the blank 100 along the bend lines 110, the end spacer portions 114 and the side spacer portions 112 of the blank 100 meet along those of their respective edges that form the legs of the trapezoids. The juxtaposition of the sharply obliquely angled edge 116 and the edge 124E of the superior end spacer portion 114 in substantially collinear relation causes the superior end spacer portion 114 to slope at a sharply oblique angle to the main ventilation portion 102 in the assembled vent protector 200 (FIGS. 2*a* to 2*d*). In contrast, in the preferred embodiment the side spacer portions 112 and the inferior spacer portion 114 are arranged to be at a much more gently oblique angle to the main ventilation portion 102 in the assembled vent protector 200. This sloping can be seen in FIG. 2*a* and FIG. 2*b*. When mounted to a dwelling as discussed below, the sharply obliquely sloping end spacer portion 114 adjacent the oblique edges 116 would face upward, making the superior end spacer portion 114 of the vent protector 200 a less attractive resting place for birds, squirrels, or other vertebrate wildlife. Further to this end, in a preferred embodiment, as shown, the superior end spacer portion 114 adjacent the oblique edges 116 does not include any ventilation apertures, since such apertures could provide a grip for birds, squirrels or the like. In other embodiments the sloped end spacer portion 114 adjacent the oblique edges 116 may include ventilation apertures. Moreover, while FIG. 1 shows only the main ventilation portion 102 and the inferior end spacer portion 114 as having ventilation apertures 104, ventilation apertures could also be formed in one or more of the side spacer portions 112.

Although shown as evenly spaced on the surface of the main ventilation portion 102, the ventilation apertures 104 may be distributed in any shape or design so long as they occupy a sufficient area to prevent back pressure of fluid when a vent protector 200 formed from the blank 100 is installed on a dwelling structure. For instance, ventilation apertures could be arranged in a variety of set designs or custom-ordered by the consumer, distributor, resellers or others to form a specified shape or pattern, such as a geometric shape, a pictorial representation, a word or phrase, or a sports team logo or other indicia. Similarly, the size and shape of the ventilation apertures can also be varied so long as the total area occupied by the ventilation apertures prevents back pressure of the fluid and the ventilation apertures remain small enough to inhibit the ingress of vertebrate wildlife. Merely by way of example, FIG. 4 (discussed further below) shows an alternate embodiment including ventilation apertures 404 that are of a substantially circular shape. Alternatively, the ventilation apertures could be another geometric shape.

FIGS. 2*a* to 2*d* show a vent protector 200 formed by folding the spacer portions 112, 114, mounting portions 108 and tabs 124 by bending the blank 100 along the bend lines 109, 110 and 111 and securing the tabs 124 to the side spacer portions 112.

Figure 3:
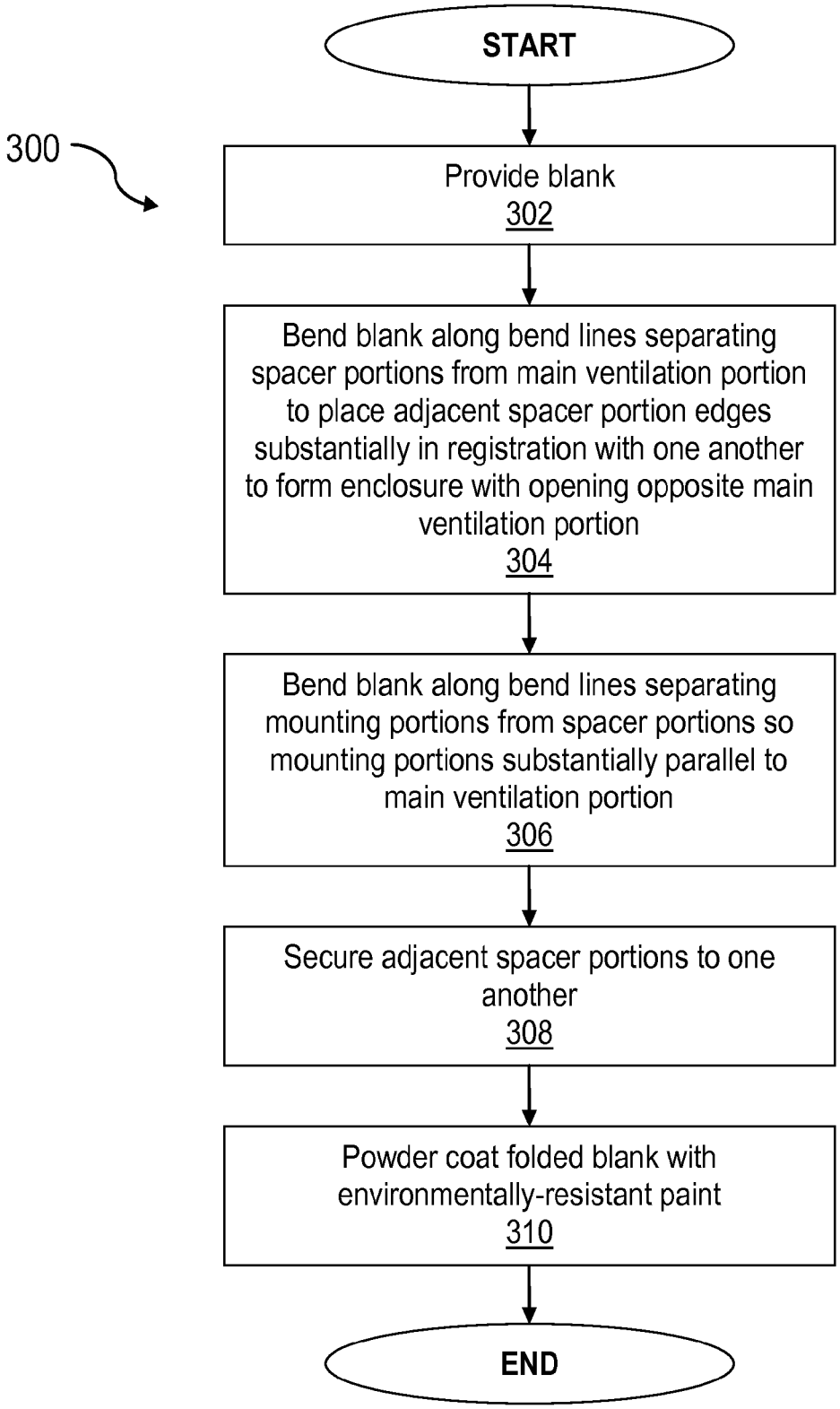
FIG. 3 is a flow chart showing an exemplary method for making a vent protector.

Reference is now made to FIG. 3, in which an exemplary method 300 for forming a vent protector from a blank, such as the blank 102 described above, is illustrated in flow chart form.

At step 302, a blank, such as the blank 102 or one of the other blanks described herein, is provided. As such, the blank will comprise a main ventilation portion having a first plurality of ventilation apertures for permitting fluid flow past the main ventilation portion and inhibiting ingress of vertebrate wildlife past the main ventilation portion, a plurality of spacer portions extending from the main ventilation portion, and mounting portions extending from at least two of the spacer portions for mounting the vent protector to a surface. The blank will be made from a monolithic metal sheet with the main ventilation portion, the spacer portions and the mounting portions being separated by bend lines. In subsequent steps, as described below, the blank is then placed in the folded configuration by folding the spacer portions, mounting portions and tabs (when present) into the appropriate positions by bending the blank along the bend lines.

For illustrative purposes, the discussion of the exemplary method 300 will reference forming the blank 100 shown in FIG. 1 into the vent protector 200 shown in FIGS. 2*a* to 2*d*; however it is to be understood that the method 300 is not limited to the blank 100 and the vent protector 200 and may be applied to other suitable types of blank/vent protector. To form such a vent protector 200, as shown in FIGS. 2*a*, 2*b*, 2*c*, and 2*d*, the blank 100 is bent along the bend lines 110, 111 and 109 (FIG. 1).

Step 304 comprises hand bending the blank 100 along the bend lines 110 separating the main ventilation portion 102 from the spacer portions 112, 114 to place adjacent edges of the spacer portions 112, 114 substantially into registration with one another to form an enclosure 130 (FIGS. 2*a* to 2*d*) with an opening 132 (FIG. 2*b*) opposite the main ventilation portion 102. It is to be appreciated that, as used in this context, the term "substantially in registration" does not require that the edges of the spacer portions 112, 114 be in physical contact, and is satisfied when the edges are closely aligned even if there is a small gap between them. Because the blank 100 must be bent so the edges of the blank 100 are substantially in registration with one another to create the vent protector 200, the spacer portions must all be folded in the same direction. However, because the front and back of the vent protector remain undefined until folding, that direction may be any direction so long as it is the same direction so as to form generally frusto-pyramidal box with an open base.

Step 306 comprises hand bending the blank along the bend lines 109 separating the mounting portions 108 from the side spacer portions 112 so that the mounting portions 108 are substantially parallel to the main ventilation portion 102. Preferably, the mounting portions 108 are folded in the direction opposite to the direction that the side spacer portions 112 are folded so that the mounting portions 108 extend outwardly from the side spacer portions 112 and the main ventilation portion 102. This configuration allows the mounting portions 108 to remain more easily accessible to receive fasteners for affixing the vent protector 200 to a surface. If the mounting portions 108 were to extend inwardly from the side spacer portions 112, fasteners could be installed through the ventilation apertures 104 if they were suitably shaped, but this would be more onerous and is therefore less preferred.

Step 308 comprises securing the adjacent spacer portions to one another. This maintains the blank 100 in the folded configuration as the vent protector 200. Where the method 300 is applied to the blank 100 shown in FIG. 1, securing the adjacent spacer portions to one another at step 308 may comprise bending the blank 100 along the tab bend lines 111 forming the boundary between the end spacer portions 114 and the tabs 124. These tabs 124 are folded in the same direction that the spacer portions 112, 114 are folded relative to the main ventilation portion 102. Folding in this direction enables the tabs 124 to be secured to the side spacer portions 112; when the spacer portions 112, 114 and the tabs 124 are all folded the tabs 124 should extend toward and overlap the side spacer portions 112, preferably interiorly thereof. Securing the adjacent spacer portions to one another at step 308 may further comprise securing the tabs 124 on the end spacer portions 114 to the side spacer portions 112. This may be done by spot welding, riveting, bolting or other suitable technique; preferably the tabs 124 are disposed interiorly of the side spacer portions 112 and spot welded in place with two spaced-apart spot welds. In such an embodiment, the blanks 100 would be distributed and sold in the folded, welded condition as a completed vent protector 200, preferably in a painted condition to provide suitable corrosion resistance.

The above bending steps 304, 306 and the bending portion of step 308 may be completed in any order, or may be intermingled. For example, a worker may bend the blank 100 to fold one of the side spacer portions 112 relative to the main ventilation portion 102, then bend the blank 100 to fold one of the mounting portions 108 relative to the side spacer portion 112, then bend the blank 100 to fold one of the tabs 124 relative to the respective end spacer portion 114 and then bend the blank to fold that end spacer portion 114 relative to the main ventilation portion 102, and so on.

Preferably, the bending at steps 304, 306 and 308 is with energy of less than about 12 inch-pounds, more preferably with energy of less than about 10 inch-pounds and still more preferably with energy of less than about 8 inch-pounds. Where the blanks are bent by hand, it is particularly advantageous for the bend lines to be perforated bend lines comprising a series of substantially linearly extending apertures, since this will reduce resistance to bending and guide the blank to bend along the bend lines rather than at undesired locations. This enables the bending steps 304, 306, 308 to be carried out entirely by hand, without the use of bending tools such as brakes. Preferably, bending steps 304, 306 and the bending portion of step 308 takes less than about 10 seconds when executed by a skilled worker.

At step 310, carried out after step 308, the folded blank is powder coated with a suitable environmentally-resistant paint.

In the folded condition illustrated in FIGS. 2*a*, 2*b*, 2*c*, and 2*d*, the mounting portions 108 are substantially parallel to one another and to the main ventilation portion 102, and the adjacent edges of the spacer portions 112, 114 are substantially in registration with one another. Additionally, the main ventilation portion 102, the side spacer portions 112, and the end spacer portions 114 cooperate to form an enclosure 130 having an opening 132 opposite the main ventilation portion 102. In an alternative embodiment, the main ventilation portion may be sloped relative to the mounting portions. Additionally, the side spacer portions may also be sloped differently than described above. Similarly, the end spacer portion that is distal to the oblique edges may be sloped away or toward the main ventilation portion.

Figure 4:
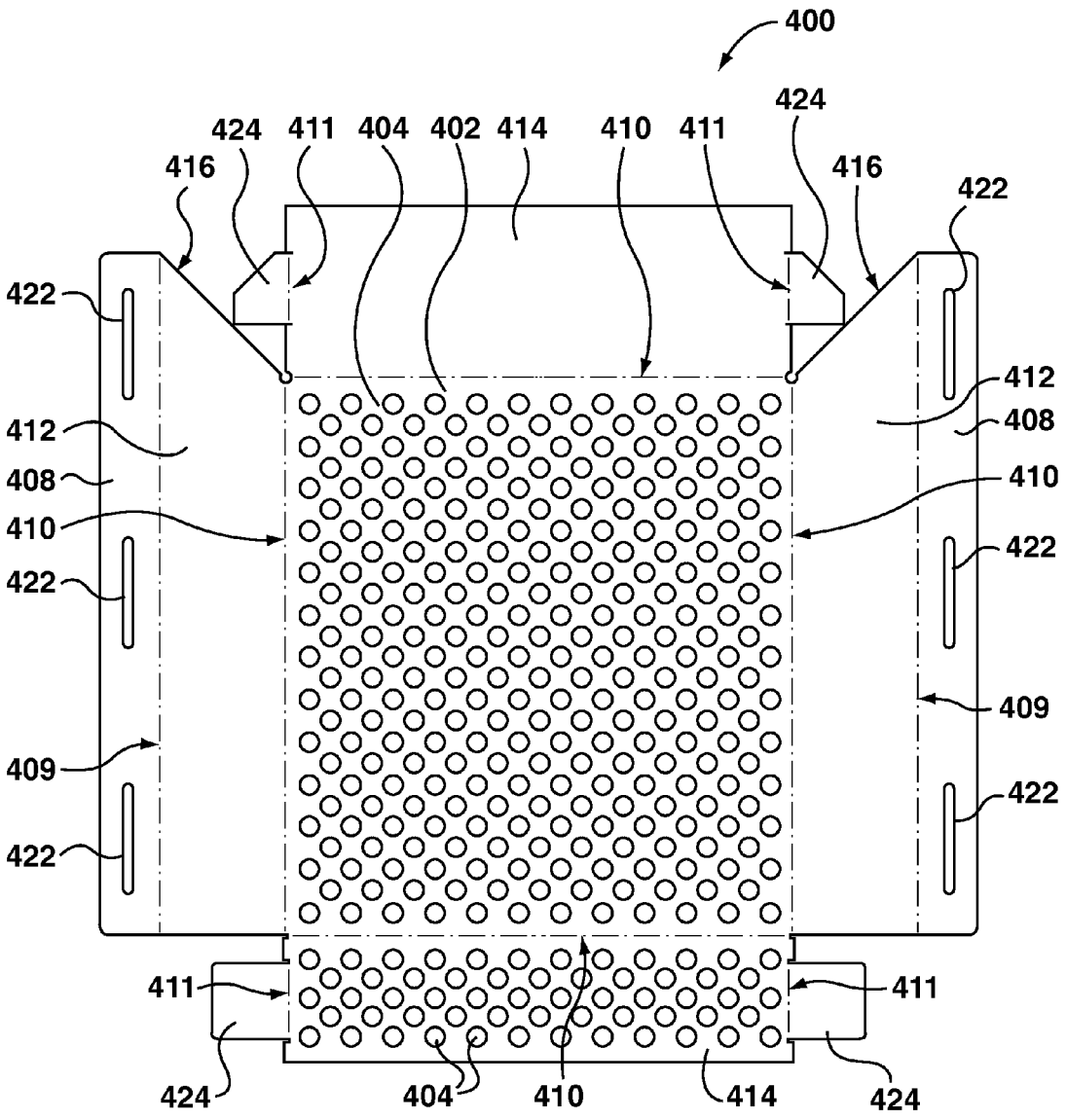
FIG. 4 is a plan view of a second exemplary blank for constructing a vent protector, shown in an unfolded condition.

FIG. 4 shows a first alternate embodiment of an exemplary blank 400. The blank 400 is similar to the blank 100, with like reference numerals denoting corresponding features, except with the prefix "4" instead of "1". The blank 400 in FIG. 4 differs from the blank 100 shown in FIG. 1 primarily in that the bend lines 409, 410, 411 are score lines cut into the blank 400 to reduce resistance to bending, the end spacer portions 414 are rectilinear rather than trapezoidal, and the side spacer portions 412 are right-angled trapezoids. In addition, the ventilation apertures 404 are circular rather than having an elongate ovoid shape. The blank 400 shown in FIG. 4 may be formed into a vent protector using the method 300 shown in FIG. 3.

Figure 5:
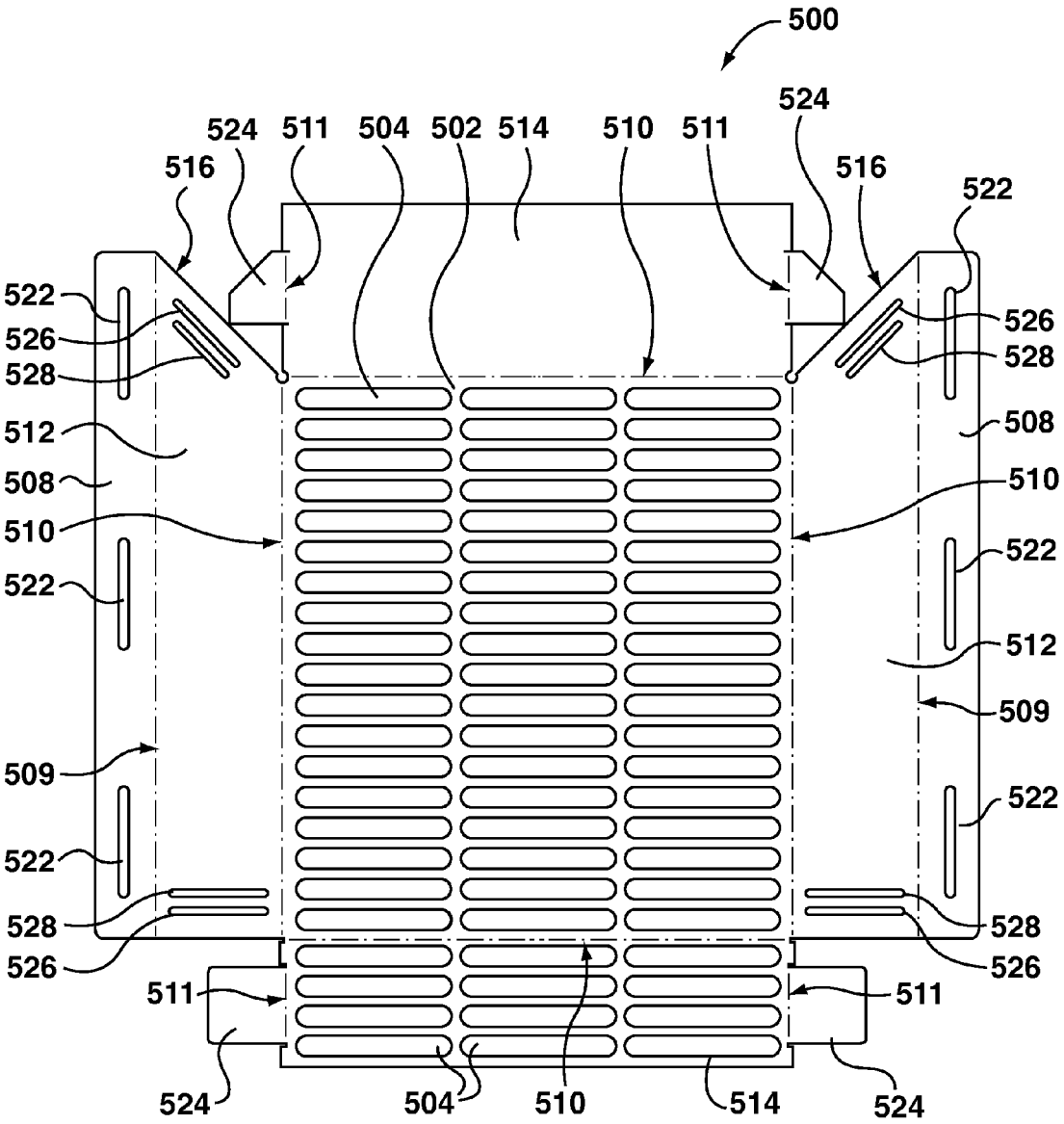
FIG. 5 is a plan view of a third exemplary blank for constructing a vent protector, shown in an unfolded condition.

Rather than being distributed and sold in a folded condition, blanks may be distributed and sold in an unfolded configuration, to be folded into a vent protector by the consumer. For example, FIG. 5 illustrates an alternate embodiment of a blank 500, which is similar to the blank 400 shown in FIG. 4 except for the shape of the ventilation apertures and the fact that it is designed to be secured in the folded configuration without welding or external fasteners. Accordingly, corresponding reference numbers refer to corresponding features except with the prefix "5" instead of "4". In this alternate embodiment, the end spacer portions 514 are secured to the side spacer portions 512 by inserting the tabs 524 into sets of spaced-apart, parallel slots 526, 528 cut into the side spacer portions 512. The spaced-apart slots 526, 528 allow each tab 524, to be inserted into the slot 526 closest to the tab 524 from within the enclosure (not shown in FIG. 5) then threaded into the slot 528 furthest from the tab 524 so that the major part of the tab 524, including the end thereof, is disposed interiorly of the side spacer portion 512. The end of the tab 524 can then be folded back on itself to prevent the tab 524 from sliding out of the slots 526, 528, thereby securing the end spacer portions 514 to the side spacer portions 512. Other mechanisms for securing the tabs may also be used; such mechanisms are known in the art and are not discussed further. Alternatively, the tabs 524 could be threaded into slot 526 from the exterior to the interior before threading into slot 528 from the interior to the exterior. Also alternatively, only one slot may be provided for each tab 524, and the tab 524 can be inserted into the slot from any direction and then folded back on itself. Although not shown in FIG. 5, the tabs 524 may be provided with suitably positioned bend lines to facilitate the folding.

Figure 9:
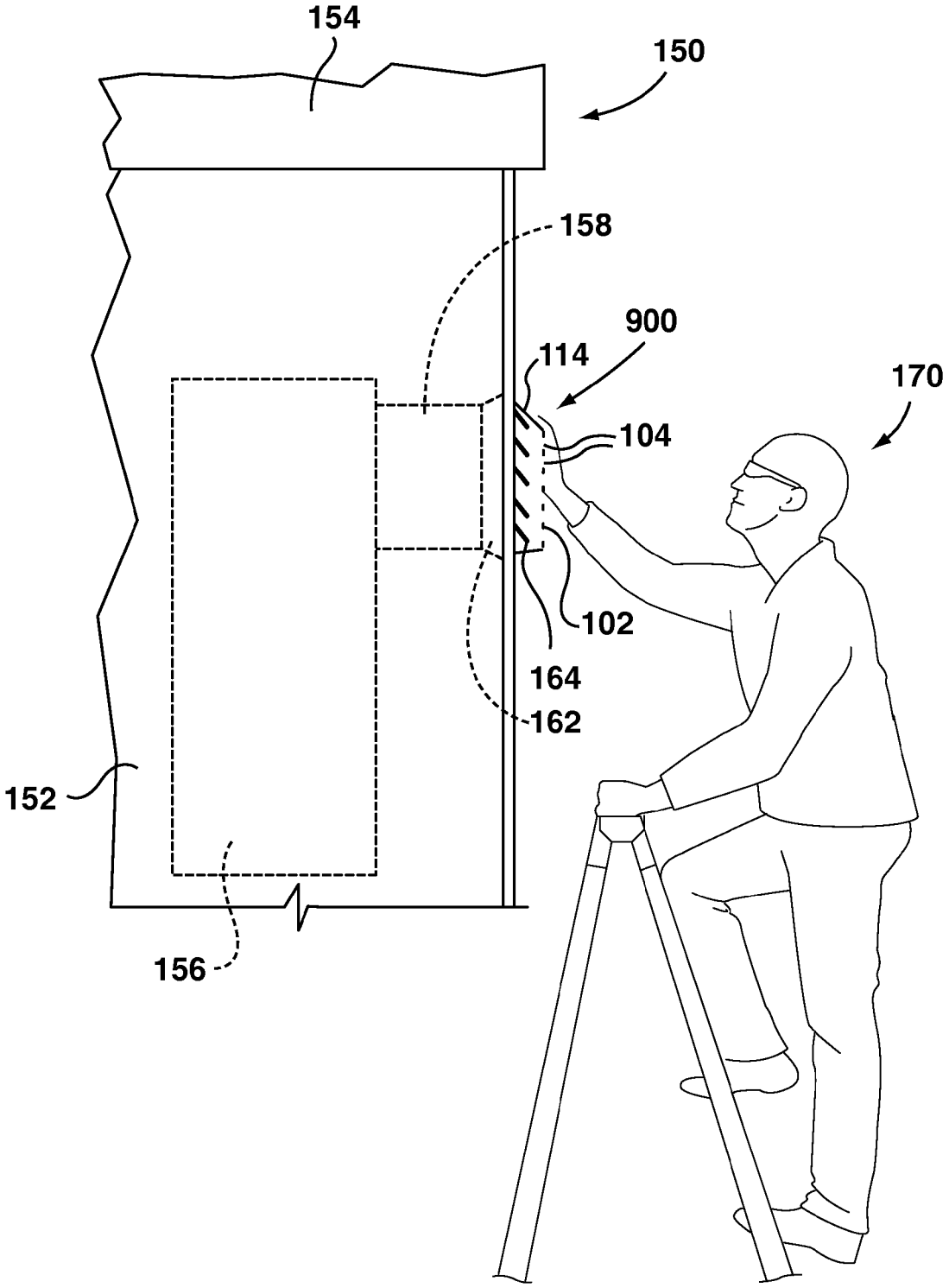
FIG. 9 is a front perspective view showing retrofitting of a dwelling structure with a vent protector.

In a preferred embodiment, the blank 500 is sold to a consumer in an unfolded condition, as shown in FIG. 5. Unfolded blanks such as the exemplary blank 500 shown in FIG. 5 can be packed tightly for shipping and will occupy less space at retail than blanks folded into the folded configuration as a vent protector. When purchased, an individual such as the consumer or the installer, can then construct a vent protector 900 (FIG. 9) by bending the blank 500 along the score lines 509, 510 and 511 and inserting the tabs 524 into the slots 526, 528 and folding the tabs 524. FIG. 9 illustrates a method of retrofitting a dwelling structure 150 with the vent protector 900. An individual 170, such as the consumer or an installer, can place the vent protector 900 over the vent structure 162. The individual 170 can then secure the vent protector 900 over the vent structure 162 of the dwelling structure 150 by fastening the mounting portions to the exterior wall 152. The size of the blank sold to the consumer can vary to accommodate different sizes of vent structures 162.

FIGS. 6*a* and 6*b* show a dwelling structure 150 having a vent protector 200 mounted thereto. The dwelling structure 150 comprises a plurality of upstanding exterior walls 152 and a roof 154 that extends over the exterior walls 152 and cooperates with the exterior walls 152 to form an interior 156 of the dwelling structure 150. A ventilation duct 158 extends from within the interior of the dwelling structure 156 to an exhaust aperture 160 (FIG. 6*b*) in one of the exterior walls 152. The ventilation duct 158 may originate from bathroom fans in the bathroom, exhausts in the kitchen, dryer vents, or other areas of the dwelling structure requiring venting. A vent structure 162 (FIG. 6*b*) is secured over the exhaust aperture 160, and the vent protector 200 is secured to the exterior wall 152 that houses the exhaust aperture 160 and vent structure 162. The vent protector 200 is secured over the vent structure 162 so that the opening 132 located opposite the main ventilation portion 102 is in registration with the vent structure 162 and the exhaust aperture 160. The vent protector 200 is secured by securing the mounting portions 108 to the relevant exterior wall 152.

The vent structure 162 comprises movable flaps 164 that are movable between a closed position and an open position. In the open position, the flaps 164 extend outwardly beyond the exterior wall 152, permitting fluid flow from the interior of the dwelling structure 156 through the exhaust aperture 160 to the exterior; the fluid flows through the gaps 166 between the flaps 164. The flaps 164 of the vent structure 162, when in the open position, extend through the opening 132 opposite the main ventilation portion 102. The flaps 164 extend into and are contained within the enclosure 130 formed by the vent protector 200. When the flaps 164 are in the open position, fluid can flow from the interior of the dwelling structure 156 through the ventilation duct 158, through the exhaust aperture 160 and the gaps between the flaps 164 into the enclosure 130, and through the ventilation apertures 104 to ambient.

When secured to an exterior wall 152 of the dwelling structure 150, the vent protector 200 is oriented so that the sloped end spacer portion 114 adjacent the obliquely angled edges 116 faces generally upwardly as the superior end spacer portion 114, sloping downwardly away from the exterior wall 152. This sloping of the superior end spacer portion 114 inhibits the sojourning thereupon of vertebrate wildlife such as squirrels and birds. Additionally, the sloping of the upwardly facing end spacer portion 114 may reduce accumulation of snow or other precipitation.

Figure 7:
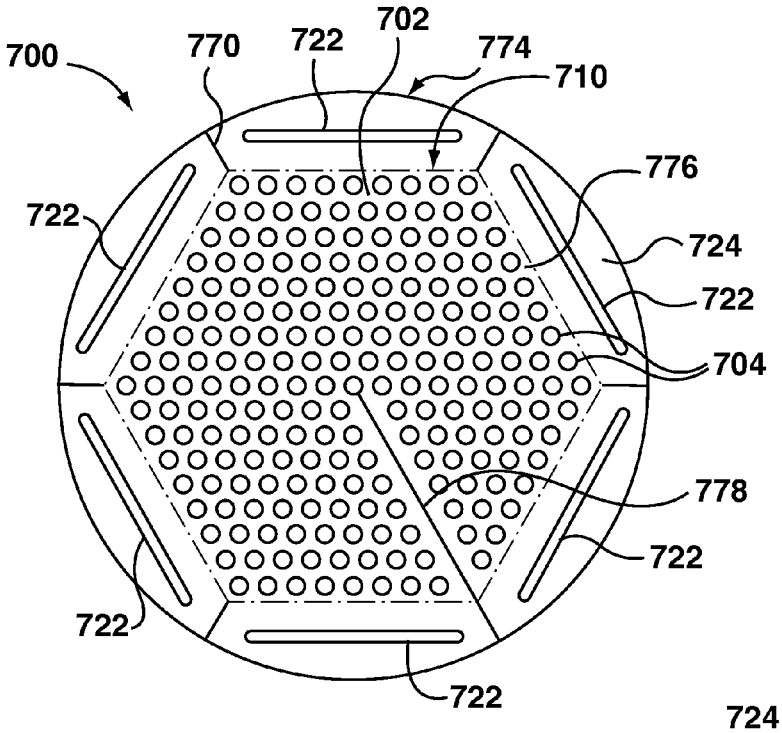
FIG. 7 is a plan view of a fourth exemplary blank for constructing a vent protector, shown in an unfolded condition.
Figure 8:
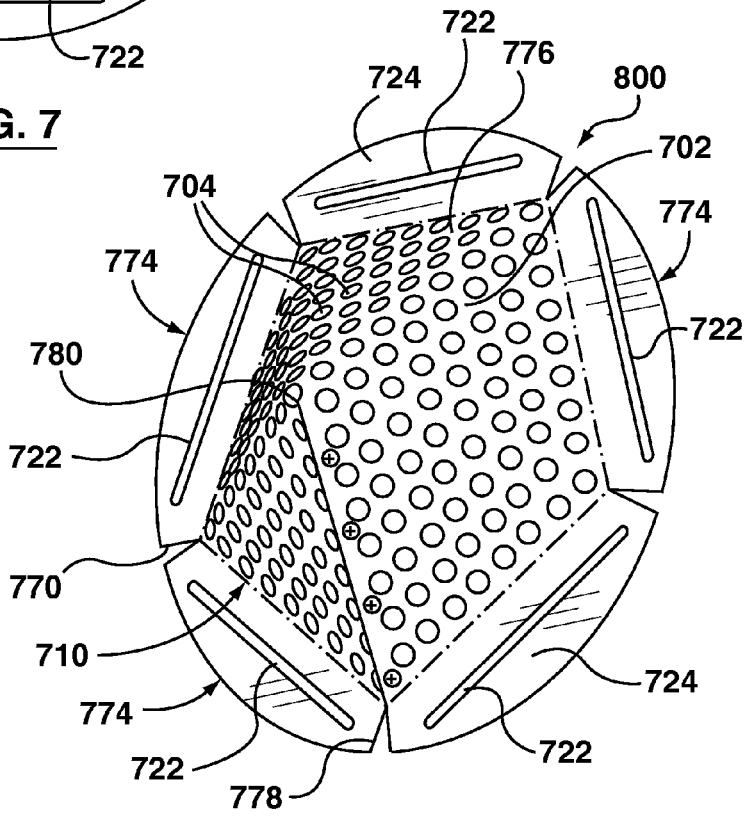
FIG. 8 is a top perspective view of a vent protector formed by a blank of FIG. 7.

A further alternate embodiment of an exemplary blank 700 for forming a vent protector 800 is shown in FIGS. 7 and 8. Here, corresponding reference numbers refer to corresponding features, except with the prefix "7" instead of "1" and "8" instead of "2". The blank 700 shown in FIG. 7 is preferably formed from sheet metal and is generally circular or ovoid, and has a plurality of tab slits 770 extending inwardly from the edge 774 thereof. In certain embodiments, the edge of the blank 700 may be crenellated, with the crenellations corresponding in position to the tab slits; this is still considered generally circular or ovoid. Score lines 710 extend circumferentially around the blank 700, spaced inwardly from the edge 774 thereof, in a regular polygonal arrangement. The tab slits 770 terminate at the score lines 710, thereby forming a plurality of outwardly extending peripheral tabs 724. The polygon 776 formed by the score lines 710 serves as a main ventilation portion, and a plurality of ventilation apertures 704 are defined therethrough. A cone-forming cut 778 extends from the center, or approximately the center, of the blank 700 to the edge 774 thereof; the cone-forming cut may take the form of a slit as shown; alternatively a sector rather than a slit, or some other suitable shape, may be cut. By sliding one of the edges formed by the cone-forming cut 778 underneath the other until the adjacent score lines 710 are aligned, the blank 700 may be formed into a generally conical shape, and the blank 700 may be secured in the conical configuration by, for example, spot welding or by tabs and slots as described above. The tabs 724 are folded toward the apex 780 of the cone, thereby completing the vent protector 800 shown in FIG. 8.

A blank, such as the blanks 100, 400 and 500 and 700 shown in FIGS. 1, 4, 5 and 7, respectively, for constructing an exemplary vent protector can be manufactured as follows. First, a monolithic sheet metal section is provided. At least for the blanks 100, 400 and 500 the sheet metal section is preferably rectangular to reduce waste, and the dimensions will depend on the desired dimensions of the vent protector to be formed from the blank. A plurality of blanks may be cut from a single sheet metal section. The ventilation apertures 104, 404, 504, 704, mounting apertures 122, 422, 522, 722 and (if applicable) bend apertures 109A, 110A, 111A and/or slots 526, 528 are formed in the sheet metal section, and (except for the blank 700 in FIG. 7) portions of the edges of the sheet metal section are cut away to produce an outer perimeter shape that partially defines the spacer portions and tabs. Typically, this will include cutting away corners of the sheet metal section to form a plurality of spacer portions 112, 114, 412, 414, 512, 514 extending from the main ventilation portion 102, 402, 502; this cutting at the corners will also preferably form tabs extending from at least some of the spacer portions. For the embodiments 400, 500 and 700 shown in FIGS. 4, 5 and 7, respectively, score lines 409, 410, 411, 509, 510, 511, 710 are cut into the sheet metal section to divide the main ventilation portion 402, 502, 702 from the spacer portions 412, 414, 512, 514 or tabs 724, divide the mounting portions 408, 508 from the side spacer portions 412, 512 and divide the tabs 424, 524 from the end spacer portions 414, 514. The foregoing steps may be carried out in any order, and some steps may be carried out substantially simultaneously. Moreover, a given step may be carried out discontinuously, with part of a step being carried out before another step and part of the step being carried out after that other step.

The blanks, including the outer perimeter shape, the ventilation apertures, the bend apertures, the mounting apertures and any other apertures, are preferably formed by punching. For example, a piece having an outline in the shape of the blank 100 may be punched from a monolithic metal sheet, and the ventilation apertures, the bend apertures and the mounting apertures may be punched in that piece to produce the blank. In the exemplary embodiment shown in FIG. 1, the ventilation apertures 104 have an elongate ovoid shape and are arranged on the main ventilation portion 102 in a pattern of three columns and sixteen rows, and on the inferior end spacer portion 114 in a regular grid pattern of three columns and four rows. This arrangement facilitates rapid punching of the ventilation apertures 104 using a specialized punch arranged to punch a sub-column of four ventilation apertures 104. In another embodiment, the cutting steps may be carried out using a CNC laser cutter.

Several currently preferred embodiments have been described by way of example. The blanks 100, 400, 500 and 700, the vent protectors formed thereby and the methods described herein are merely exemplary and various adaptations are possible. For example, score lines may be substituted for perforated lines and vice versa, and one embodiment may be adapted to incorporate one or more features of another embodiment. As such, it will be apparent to persons skilled in the art that a number of variations and modifications can be made without departing from the scope of the claims.

What is claimed is:

1. A vent protector, comprising:

a planar main ventilation portion having a first plurality of louverless ventilation apertures for permitting fluid flow past the main ventilation portion and inhibiting ingress of vertebrate wildlife past the main ventilation portion;

a plurality of spacer portions, each of the spacer portions extending from the main ventilation portion wherein adjacent edges of the spacer portions are spaced from one another and are substantially in registration with one another to form an enclosure having a single unobstructed opening opposite and commensurate with the main ventilation portion and wherein the enclosure inhibits ingress of vertebrate wildlife past the enclosure; and mounting portions extending from at least two of the spacer portions for mounting the vent protector to a surface;

wherein the main ventilation portion, the spacer portions, and the mounting portions are made from a monolithic metal sheet; and the main ventilation portion, the spacer portions, and the mounting portions are separated by bend lines.

2. The vent protector of claim 1, wherein the monolithic metal sheet is bendable along the bend lines with energy of less than 12 inch-pounds.

3. The vent protector of claim 1, wherein the bend lines comprise a series of substantially linearly arranged bend apertures to reduce resistance to bending along the bend line, relative to resistance to bending of the main ventilation portion, the spacer portions, and the mounting portions.

4. The vent protector of claim 1, wherein the monolithic metal sheet has a thickness of between 14 to 24 gauge.

5. The vent protector of claim 1, wherein the spacer portions comprise:

at least two opposed side spacer portions from which the mounting portions extend; and at least two opposed end spacer portions.

6. The vent protector of claim 5, wherein:

the main ventilation portion is rectangular;

the at least two opposed side spacer portions are two opposed trapezoidal side spacer portions; and the at least two opposed end spacer portions are two opposed non-rectangular isosceles trapezoidal end spacer portions.

7. The vent protector of claim 6, wherein:

each spacer portion has a proximal edge along the bend line separating the respective spacer portion from the main ventilation portion and a distal edge relative to the proximal edge;

for each spacer portion, the proximal edge is shorter than the distal edge so that the spacer portions taper outwardly from the main ventilation portion.

8. The vent protector of claim 5, wherein the end space portions comprise:

an inferior one of the end spacer portions and a superior one of the end spacer portions, wherein, when the vent protector is properly installed on a wall of a building, the inferior one of the end spacer portions will be closer to the ground than the superior one of the end spacer portions;

and wherein the inferior one of the end spacer portions has a second plurality of ventilation apertures formed therein for permitting fluid flow past the inferior one of the end spacer portions and inhibiting ingress of vertebrate wildlife past the inferior one of the end spacer portions.

9. The vent protector of claim 1, further comprising:

respective tabs extending from at least some of the spacer portions;

each tab being secured to an adjacent spacer portion to secure each spacer portion to each adjacent spacer portion.

10. The vent protector of claim 1, wherein:

the monolithic metal sheet has rounded cut-outs at intersection points where (a) the bend lines between the main ventilation portion and the end spacer portions and (b) the bend lines between the main ventilation portion and the side spacer portions intersect;

so that vertices of the main ventilation portion, the end spacer portions and the side spacer portions are subsumed by the cutouts.

11. A dwelling structure, comprising:

a plurality of upstanding exterior walls;

a roof that extends over the exterior walls and cooperates with the exterior walls to form an interior of the dwelling structure;

a ventilation duct extending from within the interior of the dwelling structure to an exhaust aperture in one of the exterior walls;

a vent structure secured over the exhaust aperture; and a vent protector according to claim 1 secured to the one of the exterior walls over the vent structure so that the opening opposite the main ventilation portion is in registration with the vent structure and the exhaust aperture;

the vent protector being secured by the mounting portions being secured to the one of the exterior walls.

12. The dwelling structure of claim 11, wherein:

the vent structure comprises movable flaps that are movable between a closed position and an open position;

in the open position:

the flaps extend outwardly beyond the exterior wall, permitting fluid flow from the interior of the dwelling structure through the exhaust aperture via gaps between the flaps; and the flaps extend through the opening opposite the main ventilation portion into, and the flaps are contained within, the enclosure formed by the vent protector;

so that fluid can flow from the interior of the dwelling structure through the ventilation duct, through the exhaust aperture and the gaps between the flaps into the enclosure, and through the ventilation apertures to ambient.

13. The dwelling structure of claim 11, wherein the end spacer portions comprise:

an inferior end spacer portion and a superior end spacer portion, wherein the inferior end spacer portion is closer to the ground than the superior end spacer portion; and wherein the superior end spacer portion of the vent protector slopes at an oblique angle of at least 30 degrees to the main ventilation portion of the vent protector.

14. The vent protector of claim 1, wherein:

the bend lines comprise a series of substantially linearly arranged bend apertures to reduce resistance to bending along the bend line, relative to resistance to bending of the main ventilation portion, the spacer portions, and the mounting portions; and the monolithic metal sheet has a thickness of between 14 to 24 gauge.

15. The vent protector of claim 14, wherein the spacer portions comprise:

at least two opposed side spacer portions from which the mounting portions extend; and at least two opposed end spacer portions.

16. The vent protector of claim 15, wherein:

the main ventilation portion is rectangular;

the at least two opposed side spacer portions are two opposed trapezoidal side spacer portions; and the at least two opposed end spacer portions are two opposed non-rectangular isosceles trapezoidal end spacer portions.

17. The vent protector of claim 16, wherein:

each spacer portion has a proximal edge along the bend line separating the respective spacer portion from the main ventilation portion and a distal edge relative to the proximal edge;

for each spacer portion, the proximal edge is shorter than the distal edge so that the spacer portions taper outwardly from the main ventilation portion.

18. The vent protector of claim 17, wherein the end space portions comprise:

an inferior one of the end spacer portions and a superior one of the end spacer portions, wherein, when the vent protector is properly installed on a wall of a building, the inferior one of the end spacer portions will be closer to the ground than the superior one of the end spacer portions; and wherein the inferior one of the end spacer portions has a second plurality of ventilation apertures formed therein for permitting fluid flow past the inferior one of the end spacer portions and inhibiting ingress of vertebrate wildlife past the inferior one of the end spacer portions.

19. The vent protector of claim 18, further comprising:

respective tabs extending from at least some of the spacer portions;

each tab being secured to an adjacent spacer portion to secure each spacer portion to each adjacent spacer portion.

20. The vent protector of claim 19, wherein:

the monolithic metal sheet has rounded cut-outs at intersection points where (a) the bend lines between the main ventilation portion and the end spacer portions and (b) the bend lines between the main ventilation portion and the side spacer portions intersect;

so that vertices of the main ventilation portion, the end spacer portions and the side spacer portions are subsumed by the cutouts.

* * * * *